US008871033B2

(12) United States Patent
Zink

(10) Patent No.: US 8,871,033 B2
(45) Date of Patent: Oct. 28, 2014

(54) APPARATUS FOR INSERTION IN A TANK AND METHOD THEREOF

(75) Inventor: Gerald P. Zink, Durango, CO (US)

(73) Assignee: Stoneage, Inc., Durango, CO (US)

( * ) Notice: Subject to any disclaimer, the term of this patent is extended or adjusted under 35 U.S.C. 154(b) by 739 days.

(21) Appl. No.: 13/078,634

(22) Filed: Apr. 1, 2011

(65) Prior Publication Data

US 2012/0247570 A1 Oct. 4, 2012

(51) Int. Cl.
*B08B 9/093* (2006.01)
*B08B 9/043* (2006.01)

(52) U.S. Cl.
CPC ..... *B08B 9/043* (2013.01); *B08B 9/093* (2013.01)
USPC ..... 134/166 R; 134/167 R

(58) Field of Classification Search
CPC ..... B08B 9/081; B08B 3/024; B08B 9/043; B08B 9/093; B63B 57/02
USPC ..... 134/166 R, 167 R, 172
See application file for complete search history.

(56) References Cited

U.S. PATENT DOCUMENTS

| | | | | |
|---|---|---|---|---|
| 4,132,041 | A | 1/1979 | Van den Broek | |
| 4,163,455 | A | 8/1979 | Hebert et al. | |
| 4,172,492 | A | 10/1979 | Abell et al. | |
| 4,201,597 | A | 5/1980 | Armstrong et al. | |
| 4,220,170 | A | 9/1980 | Hebert et al. | |
| 4,630,741 | A | 12/1986 | Stevens | |
| 4,691,723 | A | 9/1987 | Mierswa et al. | |
| 4,856,545 | A * | 8/1989 | Krajicek et al. | 134/166 C |
| 4,941,493 | A | 7/1990 | Wieringa | |
| 5,107,879 | A | 4/1992 | Harvey | |
| 5,194,217 | A * | 3/1993 | St. Louis et al. | 376/316 |
| 5,352,298 | A | 10/1994 | Moulder | |
| 5,392,798 | A | 2/1995 | Hirose et al. | |
| 5,518,553 | A | 5/1996 | Moulder | |
| 5,720,310 | A | 2/1998 | Moulder | |
| 5,956,077 | A | 9/1999 | Qureshi et al. | |
| 6,021,793 | A | 2/2000 | Moulder | |
| 6,105,593 | A * | 8/2000 | MacLaren et al. | 134/167 R |
| 6,192,905 | B1 | 2/2001 | Mincy et al. | |
| 6,213,134 | B1 | 4/2001 | Pike | |
| 6,837,642 | B1 | 1/2005 | Lin | |
| 7,044,144 | B2 | 5/2006 | Hebert | |
| 7,261,109 | B2 * | 8/2007 | Luke et al. | 134/22.1 |
| 2005/0183745 | A1 * | 8/2005 | Glicksman | 134/22.18 |

FOREIGN PATENT DOCUMENTS

| | | | |
|---|---|---|---|
| GB | 511564 A | * | 8/1939 |
| JP | 63184593 | | 7/1988 |
| JP | 1285596 | | 11/1989 |
| WO | WO03/099472 | | 12/2003 |

* cited by examiner

*Primary Examiner* — Joseph L Perrin
*Assistant Examiner* — Kevin G Lee
(74) *Attorney, Agent, or Firm* — Greenberg Traurig, LLP

(57) ABSTRACT

An apparatus for insertion in an enclosed space, including: a tube with: first and second substantially straight portions including first and second ends of the tube, respectively; and a curved portion connecting the first and second portions. The apparatus includes: a plurality of nested segments at least partially disposed within the first substantially straight portion of the tube and connected to the first substantially straight portion; and a first actuator engageable with the tube to displace the first and second substantially straight portions of the tube into and out of the enclosed space through an opening into the enclosed space. The tube is arranged to accept a hose passing through the tube, and a distal segment from the plurality of nested segments is connectable to the hose.

25 Claims, 13 Drawing Sheets

APPARATUS FOR INSERTION IN A TANK AND METHOD THEREOF

FIELD OF THE INVENTION

The present disclosure relates generally to an apparatus for insertion in a tank and a method for inserting an apparatus into an interior space of a tank. In particular, the present disclosure relates to an apparatus including a tube with a curved portion connecting straight portions, insertable through an opening in the tank. The tube can be used to convey high pressure fluids for cleaning the interior of the tank.

BACKGROUND OF THE INVENTION

It is known to insert various devices through an opening in a tank into an interior space of tank to clean an interior of the tank. One principle of operation associated with these devices is inserting a device through the opening in the interior of the tank and then rotating the device to dispense cleaning fluid. Another principle of operation associated with these respective portions is connecting first and second straight sections with a pivoting joint and inserting the sections into the tank so that the first section is located in the tank interior and the joint located in the opening or the tank interior. Cleaning fluid is then dispensed from the first section. The cleaning power of these devices is lessened by the limited access available in the tank interior for these devices, for example, these devices can remain relatively distant from the ends of the tank.

It is known for the various devices to include respective portions that are minimized for passage through the opening and maximized once inside the tank. Once maximized, the portions are used to dispense cleaning fluid. One principle of operation associated with these respective portions is use of a plurality of straight sections of pipe connected by swivel joints. The sections are folded together for insertion in the tank and then unfolded once inside the tank. Another principle of operation associated with these respective portions is use of a scissors or accordion arrangement that is folded together for insertion in a tank and then unfolded once inside the tank. The number of pipes or scissors sections, for example, usable with these devices, and hence the extent to which these devices can expand to reach all areas of the tank interior, is limited by the fact that the folded pipes and scissors sections must first fit through the limited space of the tank opening. That is, the size of the opening limits the number of folded pipes or scissors sections that can be inserted into the tank. Further, to enable a hose to be folded or scissored, the hose must necessarily be relatively flexible, which reduces the durability and pressure rating of the hose.

It is known to insert a device through an opening in a tank into an interior space of tank to inspect the interior of the tank. A principle of operation described for this device is use of a plurality of straight sections connected end to end with pivoting joints to form a chain. The chain is then fed into the interior of the tank. Once inside the tank, the chained sections are locked into a linear configuration. However, the chain structure is not sturdy enough to use for cleaning operations.

SUMMARY OF THE INVENTION

According to aspects illustrated herein, there is provided an apparatus for insertion in an enclosed space, including: a tube with: first and second substantially straight portions including first and second ends of the tube, respectively; and a curved portion connecting the first and second portions. The apparatus includes: a plurality of nested segments at least partially disposed within the first substantially straight portion of the tube and connected to the first substantially straight portion; and a first actuator engageable with the tube to displace the first and second substantially straight portions of the tube into and out of the enclosed space through an opening into the enclosed space. The tube is arranged to accept a hose passing through the tube, and a distal segment from the plurality of nested segments is connectable to the hose.

According to aspects illustrated herein, there is provided a method for positioning an apparatus within an enclosed space, including: positioning at least a portion of a plurality of nested segments within a first substantially straight portion of a tube, the first portion including a first end of the tube; placing a hose in the tube; connecting the hose to a distal segment from the plurality of nested segments; engaging the first portion of the tube, a second substantially straight portion of the tube, and a curved portion of the tube, between the first and second portions of the tube, with a first actuator; and displacing, using the first actuator, the tube through an opening into the enclosed space such that the first substantially straight portion, at least a part of the second substantially straight portion, and the curved portion are positioned within the enclosed space.

According to aspects illustrated herein, there is provided an apparatus for insertion in a vessel, including: a tube including: first and second substantially straight portions including first and second ends of the tube, respectively; a curved portion connecting the first and second portions; and an exterior surface with a plurality of indentations or openings. The apparatus includes: a plurality of telescoping segments at least partially disposed within the first portion at the first end of the tube; and an actuator including a rotatable gear with a plurality of teeth engageable with the plurality of indentations or openings so that rotation of the gear displaces the first portion, the curved portion, and part of the second portion of the tube into and out of the vessel. The first substantially straight portion has a length greater than a width of an opening for the vessel. The tube is arranged to accept a hose passing through the tube. The hose is connectable to a distal segment from the plurality of telescoping segments. Displacement of the hose in a first direction causes respective portions of the telescoping segments to displace away from the first end of the tube. Displacement of the hose in a second direction, opposite the first direction, causes the respective portions of the telescoping segments to displace toward the first end of the tube.

According to aspects illustrated herein, there is provided a method for positioning an apparatus within a vessel, including: fixing a location of an actuator outside of the vessel, the actuator including a rotatable gear with a plurality of teeth; passing a hose through a tube, the tube including: a first substantially straight portion having a length greater than a width of an opening for the vessel and including a first end of the tube; a second substantially straight portion including a second end of the tube; a curved portion connecting the first and second portions; and a plurality of indentations or openings along an exterior surface of the tube. The method includes fixing the hose to a distal segment from a plurality of telescoping segments at least partially disposed within the first portion of the tube; engaging at least one tooth from the plurality of teeth with an indentation or opening from the plurality of indentations or openings proximate the first end; and rotating the gear so that: successive indentations or openings along the first portion are engaged by the plurality of teeth and the first portion displaces through an opening for the vessel into the vessel; and respective portions of the plurality of indentations or openings along the curved portion and the second portion are engaged in sequence by the plurality of teeth so that: the first portion aligns with a horizontal line within the vessel or is at an acute angle with respect to the horizontal line; and a vertical position of the first portion varies while maintaining the alignment of the first portion with the horizontal line or while maintaining the first portion at the acute angle. The method displaces the hose through the tube to displace respective portions of the telescoping segments away from and toward the first end of the tube.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION OF THE PREFERRED EMBODIMENT

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

It should be understood that the use of "or" in the present application is with respect to a "non-exclusive" arrangement, unless stated otherwise. For example, when saying that "item x is A or B," it is understood that this can mean one of the following: 1) item x is only one or the other of A and B; and 2) item x is both A and B. Alternately stated, the word "or" is not used to define an "exclusive or" arrangement. For example, an "exclusive or" arrangement for the statement "item x is A or B" would require that x can be only one of A and B.

Figure 1:
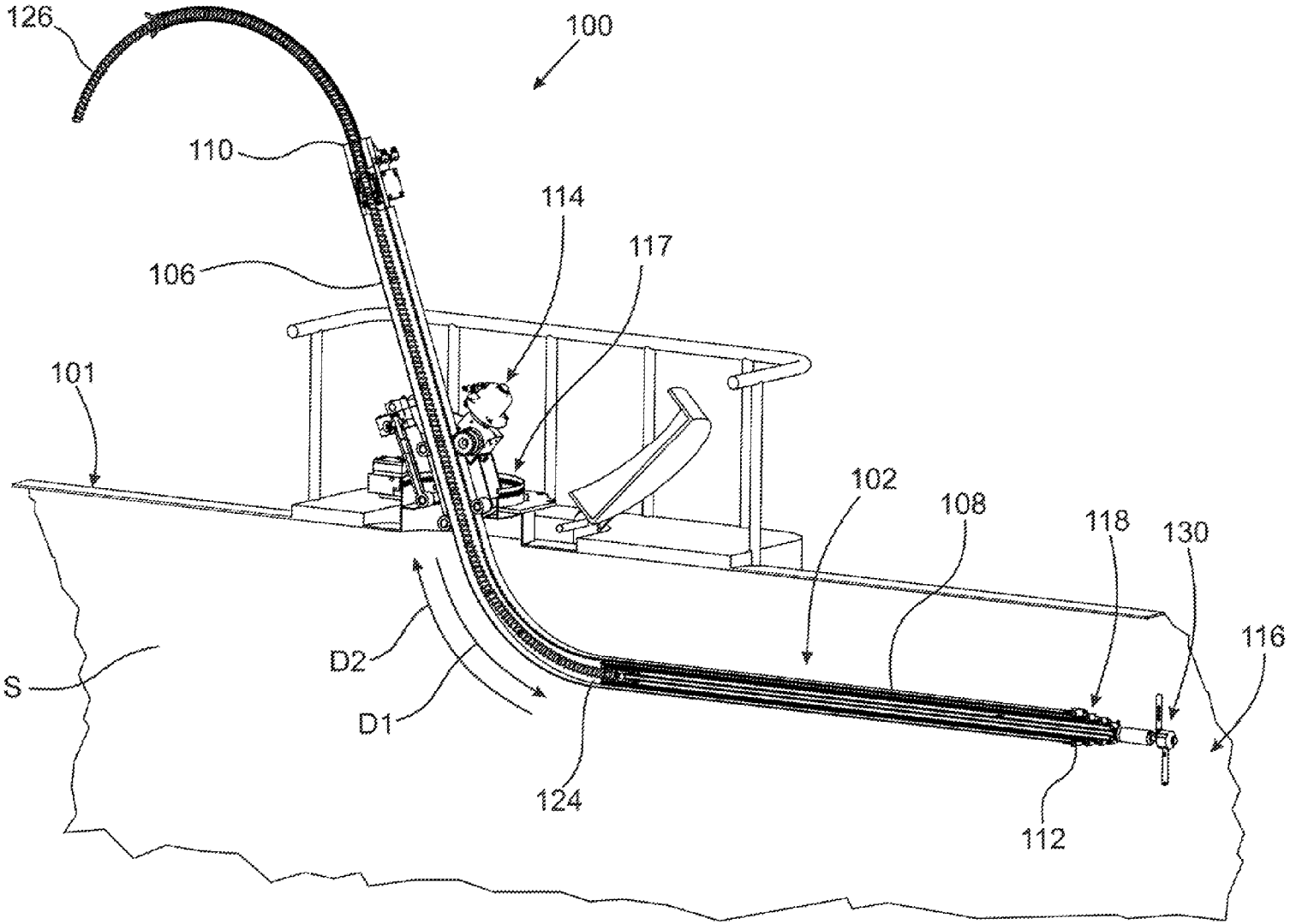
FIG. 1 is a perspective view of an apparatus for insertion in an enclosed space with a side forming the enclosed space partially cut-away, a tube and telescoping mechanism partially cut-away, and the telescoping mechanism fully retracted.

FIG. 1 is a perspective view of apparatus 100 for insertion in an enclosed space with a side forming the enclosed space partially cut-away, a tube and telescoping mechanism partially cut-away, and the telescoping mechanism fully retracted.

Figure 2:
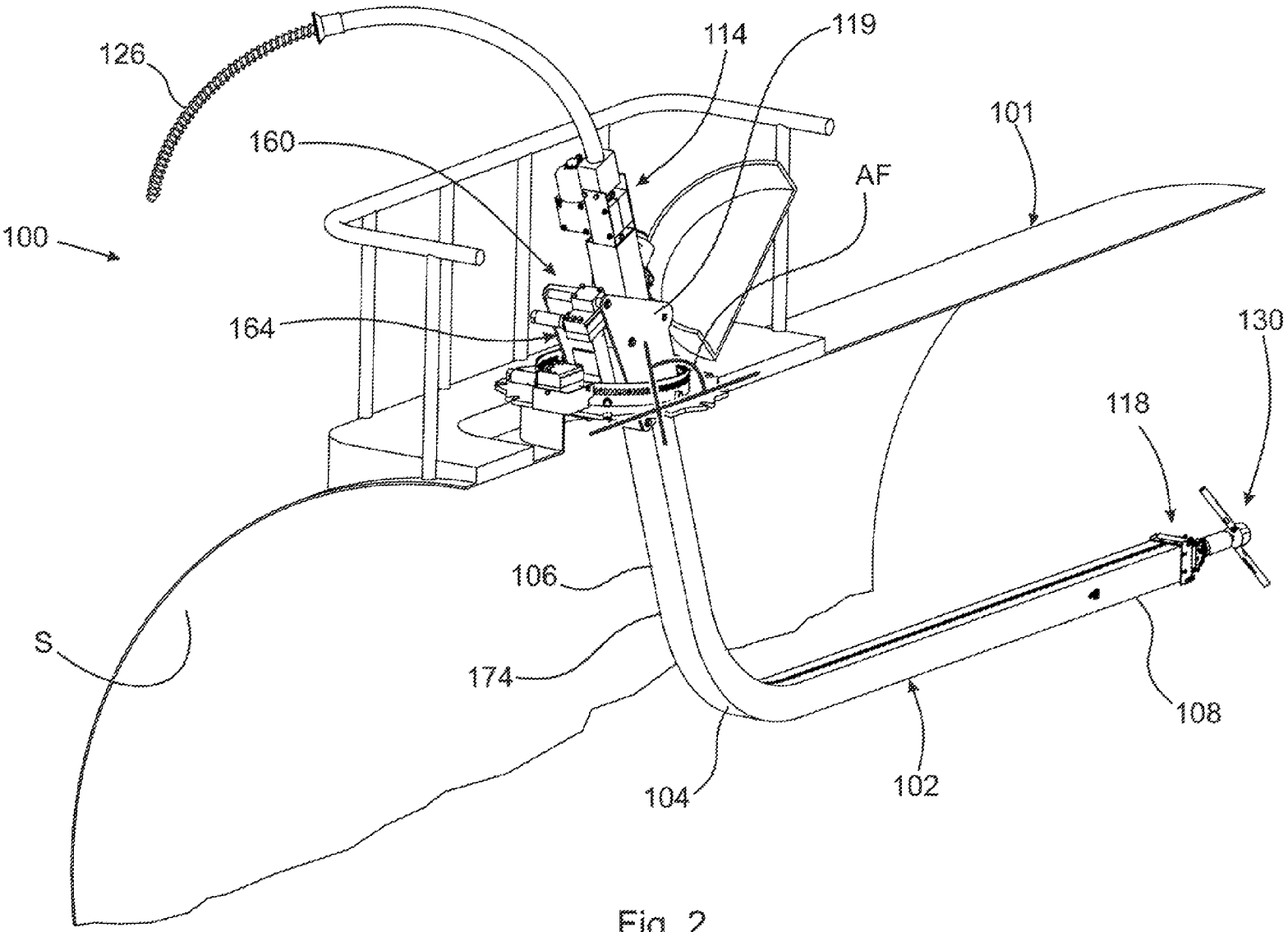
FIG. 2 is a perspective view of the apparatus shown in FIG. 1 with a side forming the enclosed space partially cut-away.

FIG. 2 is a perspective view of apparatus 100 shown in FIG. 1 with a side forming the enclosed space partially cut-away.

Figure 3:
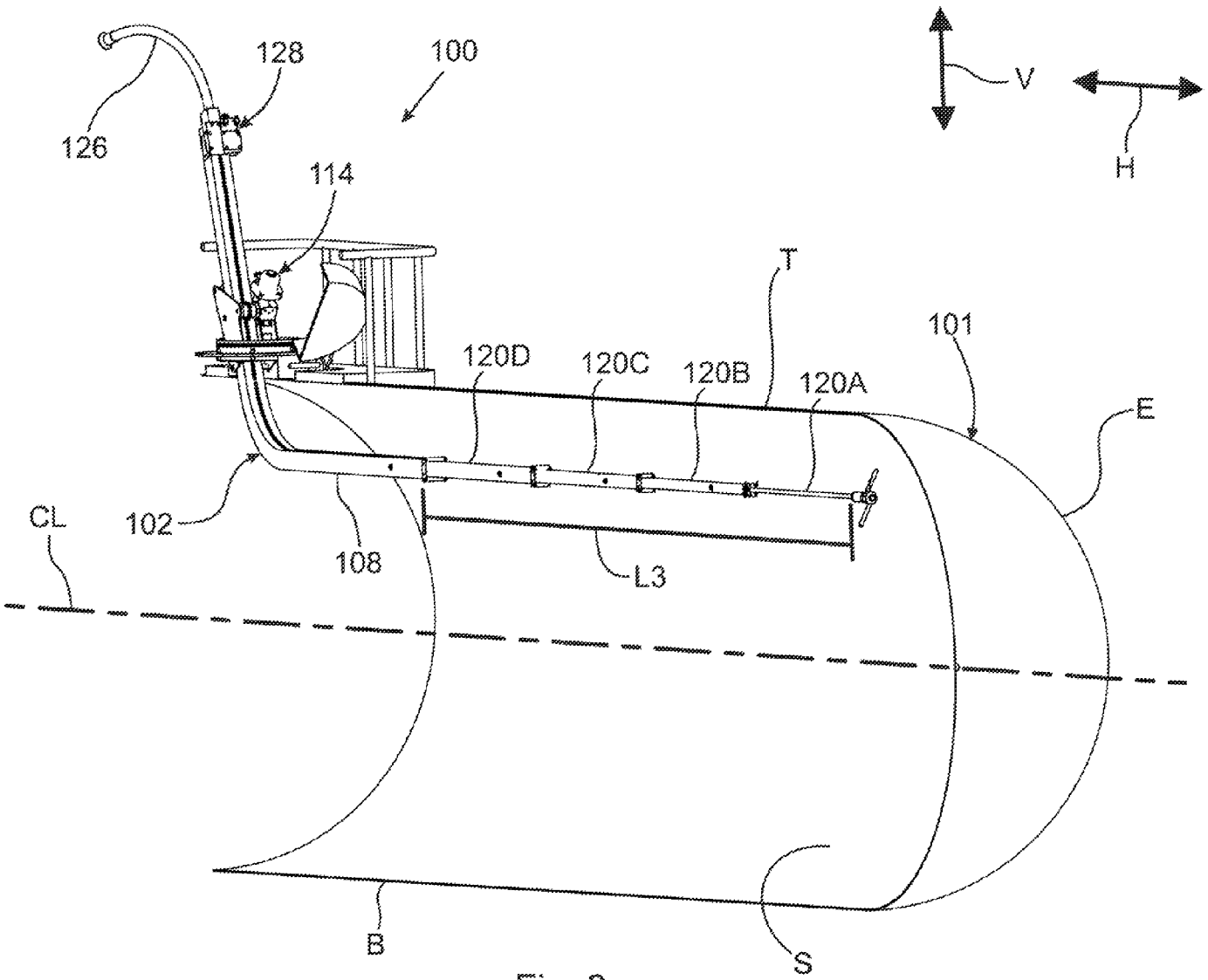
FIG. 3 is a perspective view of the apparatus shown in FIG. 1 with the telescoping mechanism fully extended.
Figure 4:
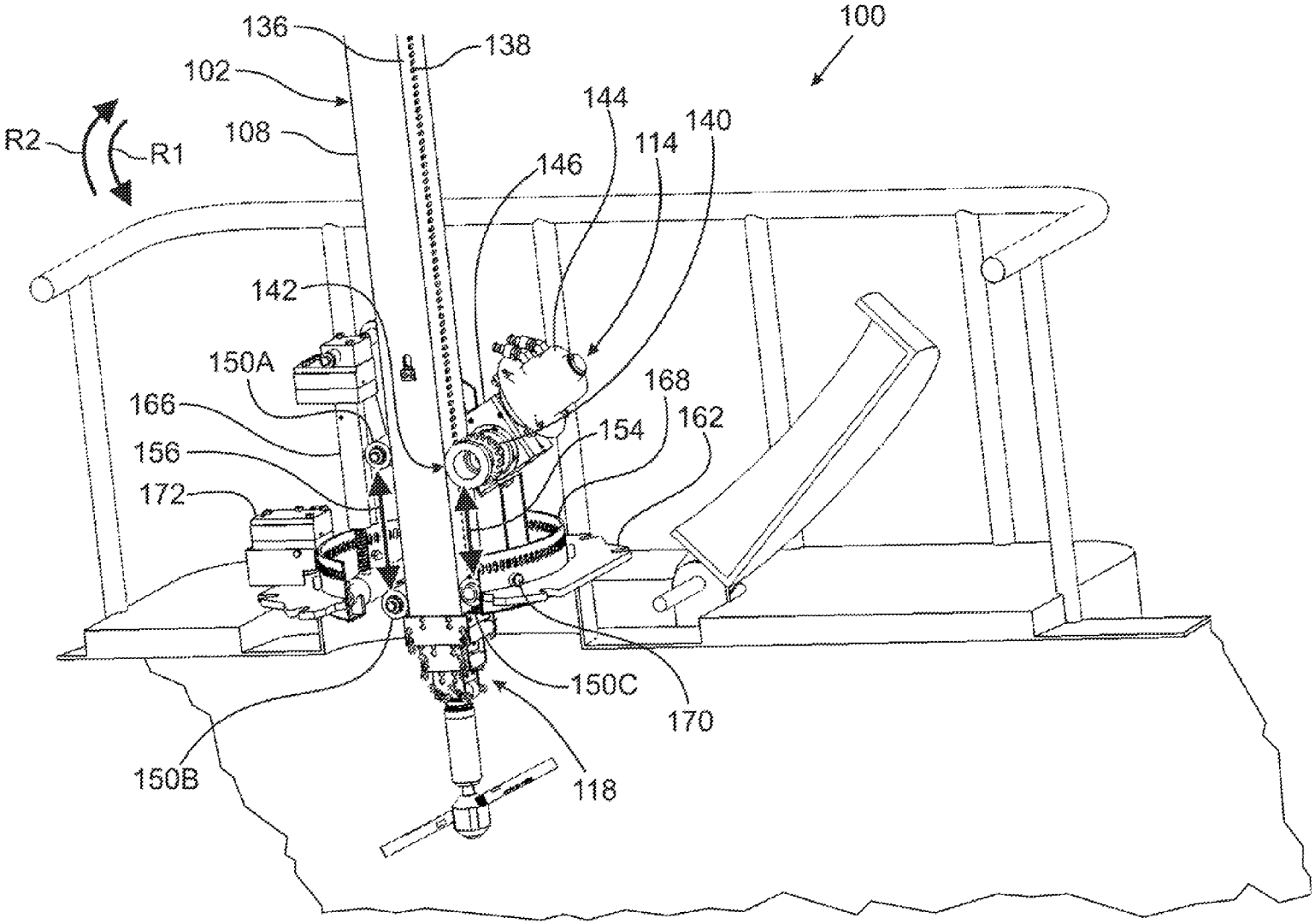
FIG. 4 is a perspective view of the actuator shown in FIG. 1 with a side plate for the apparatus removed.

FIG. 3 is a perspective view of apparatus 100 shown in FIG. 1 with the telescoping mechanism fully extended;

FIG. 4 is a perspective view of the actuator shown in FIG. 1 with a side plate for the apparatus removed.

Figure 5:
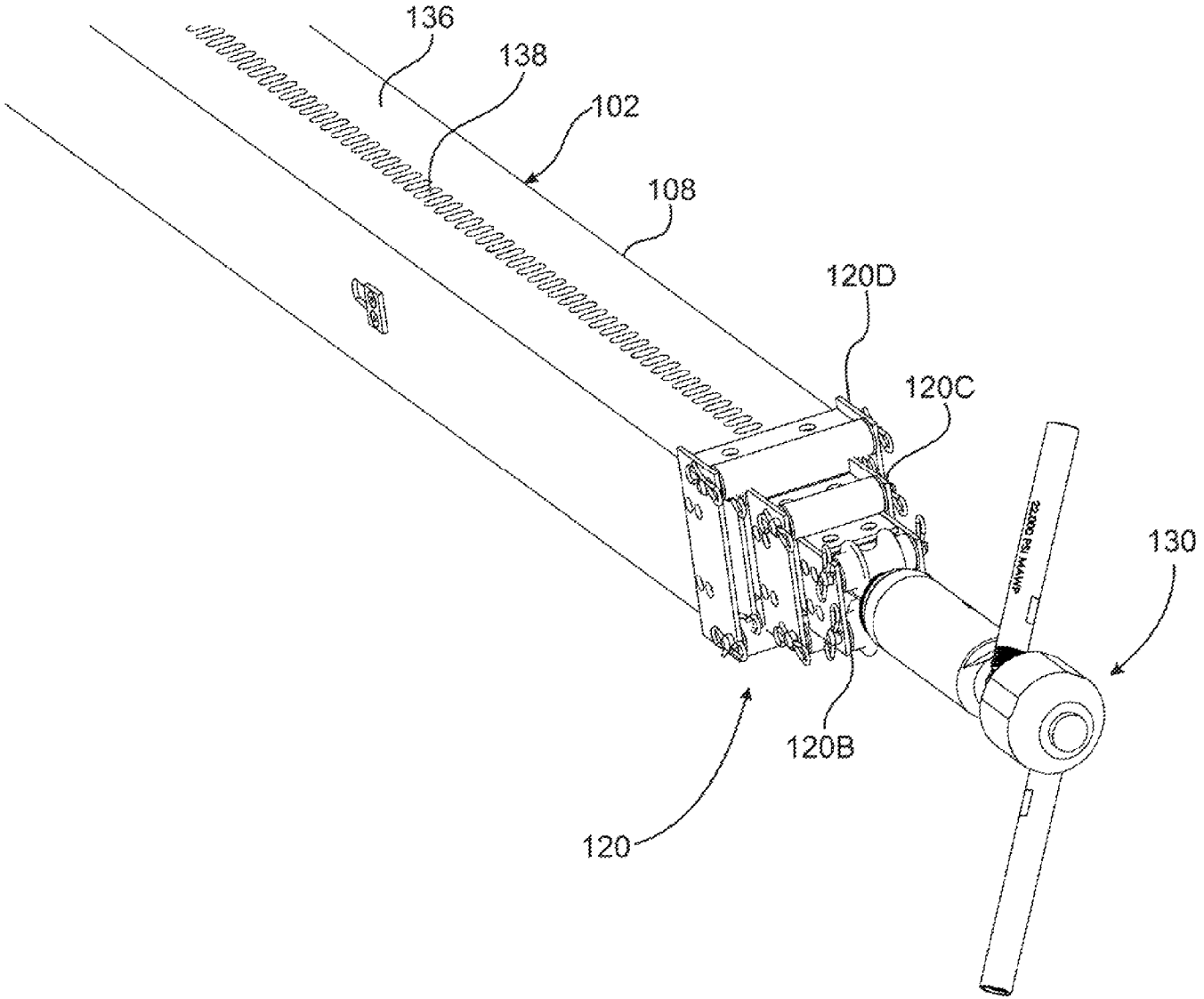
FIG. 5 is a perspective view of the telescoping mechanism shown in FIG. 1 fully withdrawn.

FIG. 5 is a perspective view of the telescoping mechanism shown in Figure fully withdrawn. The following should be viewed in light of FIGS. 1 through 5. By "enclosed space" we mean any interior space formed by a surrounding structure or vessel. Examples of an enclosed space include, but are not limited to, respective interior spaces formed by: an above ground storage tank, an underground storage tank, a rail tank car, a cylindrical storage tank with a horizontally disposed axis, a cylindrical storage tank with a vertically disposed axis, a symmetrical vessel, an asymmetrical vessel, a wastewater treatment structure, a boiler, a reactor, an oven, and a coker. In the discussion that follows, the enclosed space is formed by cylindrical tank 101; however, it should be understood that apparatus is not limited to an enclosed space formed by a tank and that the discussion is applicable to any enclosed space.

Apparatus 100 includes tube 102 with curved portion 104 and portions 106 and 108. Portions 106 and 108 include ends 110 and 112, respectively, of the tube. In an example embodiment, portions 106 and 108 are substantially straight. By substantially straight we mean the portions are fully straight or are only very slightly curved, for example, due to material or fabrication tolerances. The apparatus includes actuator 114 engageable with the tube to displace the tube into and out of enclosed space 116 of the tank via opening 117 for the tank, as further described below. In an example embodiment, tube 102 has a rectangular, for example, square, cross-section. In FIG. 4, side plate 119 has been removed to show portions of the actuator.

Apparatus 100 also includes telescoping mechanism 118 at least partially disposed within portion 108 of the tube at end 112 and connected to end 112. The mechanism includes a plurality of nested, or telescoping, segments 120 including distal segment 120A. By nested or telescoping, we mean that the various segments are mostly contained within the tube or another segment in a retracted mode, and the various segments extend from the tube or the other segment in an extended mode. For example, the extended mode is shown in FIG. 3 and the retracted mode is shown in FIG. 1. That is, the various segments are slideable into and out of the tube or an adjoining segment. For example, segment 120A is slideable into and out of segment 120B, which is slideable into and out of segment 120C, which is slideable into and out of segment 120D, which is slideable into and out of the tube. By distal segment, we mean the segment furthest from the tube, the segment furthest extendable from the tube, or the most interiorly positioned segment. Although a specific number of nested segments are shown in the figures, it should be understood that apparatus 100 is not limited to a particular number of nested segments and that other numbers of nested segments are possible.

The tube inherently includes passageway 124 from end 110 to end 112. The passageway is arranged to accept hose 126 passing through the passageway. Hose 126 can be any suitably sized hose known in the art, for example, hose 126 can be a suitably sized high pressure fluid hose. In an example embodiment, the hose is arranged to connect to the distal segment. In an example embodiment, distal segment 120A is a tube. Displacement of the hose in direction D1 from end 110 of the tube toward end 112 of the tube causes respective portions of the nested segments to displace away from end 112 of the tube, for example, as shown in FIG. 3. Displacement of the hose in direction D2 from end 112 of the tube to end 110 of the tube causes the respective portions of the nested segments to displace toward end 112 of the tube, for example, as shown in FIG. 1. Thus, the displacement of the hose causes the extension and retraction of the telescoping mechanism.

In an example embodiment, apparatus 100 includes actuator 128 engageable with the hose to displace the hose in directions D1 and D2. In an example embodiment, the actuator is as described in commonly owned U.S. patent application Ser. No. 12/723,410, filed Mar. 12, 2010, which application is incorporated herein in its entirety. In an example embodiment, the distal segment is arranged to connect to nozzle assembly 130. Any nozzle known in the art can be used. The hose can be used to feed high pressure fluid, for example, water or a combination of water and cleaning agents, to the nozzle. The fluid is then dispelled from the nozzle to clean inside surface S of the tank. However, it should be understood that apparatus 100 is not limited to the preceding operations, for example, apparatus 100 could be used to insert video equipment to visually inspect the tank interior, or to insert diagnostic or other equipment to evaluate the tank.

In an example embodiment, the tube includes exterior surface 136 with plurality of gripping features 138 along at least a portion of the exterior surface, and the actuator includes a plurality of gripping features 140. Features 138 and 140 are engageable with each other. In an example embodiment, features 138 are openings or indentations and features 140 are protrusions. The displacement of features 140 causes the displacement of the tube into and out of the interior space of the tank. In an example embodiment, the actuator includes rotatable gear 142 and radially outwardly disposed teeth for the gear form features 140. Rotation of gear 142 in direction R1 causes the displacement of the tube into the interior space of the tank, and rotation of gear 142 in direction R2, opposite R1, causes displacement of the tube out of the interior space of the tank.

In an example embodiment, actuator 114 includes motor 144 and transmission element 146. Motor 144 can be any motor known in the art. In an example embodiment, motor 144 is a pneumatic motor. In an example embodiment, gear 142 is part of element 146. That is, motor 144 drives element 146 including gear 142. In an example embodiment, apparatus 100 includes stabilizing element 148 with a plurality of rollers 150 for stabilizing the tube with respect to the actuator and the tank and facilitating transition of the tube. In an example embodiment, element 148 includes three rollers 150. Roller 150A keeps features 138 and 140 engaged and rollers 150B and 150C align the tube, for example, with respect to opening 117 of the tank. Displacement of tube 102 by actuator 114 is further described below. The configuration of the rollers is optimized to hold either straight portions 106 and 108 or curved portion 104 with a minimum of backlash.

As shown in FIGS. 2 and 4, actuator 114 is placed in a fixed position with respect to tank 101 by any means known in the art. In an example embodiment, actuator 114 is in alignment with opening 152. To displace the tube into the tank, features 138, proximate end 112 of the tube, are engaged with gear 142. Motor 144 rotates gear 142 in direction R1 so that end 112 passes through and past rollers 150B and 150C. Telescoping mechanism 118 is fully retracted in FIGS. 1, 2 and 4; however, it should be understood that mechanism 118 could be at least partially extended.

In the discussion that follows, tank 101 is aligned such that center line CL for the tank is aligned with horizontal direction H. Vertical direction V is orthogonal to the center line. "Down" is considered from top T of the tank to bottom B of the tank in the vertical direction, and "up" is considered from B to T in the vertical direction.

In an example embodiment, the tube is displaceable into an enclosed space, for example, as formed by tank 101 such that portion 108 is horizontal. In an example embodiment, the tube is displaceable into an enclosed space, for example, as formed by tank 101 such that portion 108 is parallel to center line CL for the tank. In an example embodiment, portion 106 is displaceable by actuator 114 to vary a vertical position of portion 108, while maintaining portion 108 in a horizontal orientation, for example, parallel to center line CL. That is, portion 108 is displaceable up and down while maintaining a horizontal orientation or a parallel orientation with respect to CL.

Figure 6:
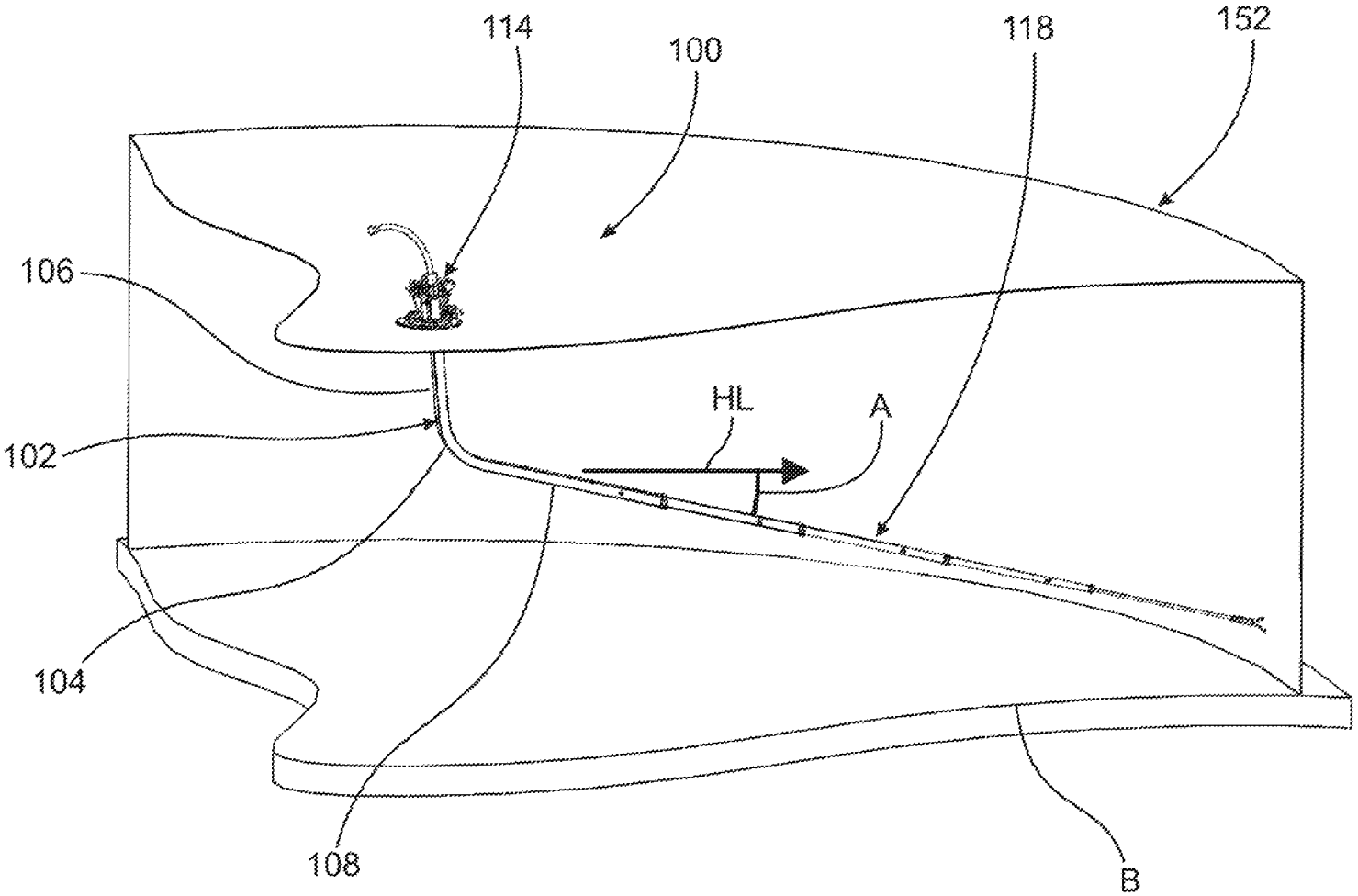
FIG. 6 is a perspective view of an apparatus for insertion in an enclosed space with a side forming the enclosed space partially cut-away and the telescoping mechanism fully extended.

FIG. 6 is a perspective view of apparatus 100 for insertion in an enclosed space with a side forming the enclosed space partially cut-away and the telescoping mechanism fully extended. The following should be viewed in light of FIGS. 1 through 6. FIG. 6 illustrates cylindrical storage tank 152 with a vertical axis and a horizontal bottom B. In an example embodiment, the tube is displaceable into an enclosed space, for example, as formed by tank 152, such that portion 108 is at acute angle A with respect to horizontal line HL. In an example embodiment, portion 106 is displaceable by actuator 114 to vary a vertical position of portion 108 within the enclosed space while keeping portion 108 at acute angle A with respect to the horizontal line. That is, portion 108 is displaceable up and down while maintaining angle A with respect to HL. The displacement of tube 102 within an enclosed space is further described infra. Thus, in general, portion 108 can be held in a particular orientation with respect to a first direction while being displaced in a second direction orthogonal to the first direction.

Thus, apparatus 100 is positionable to access a wide variety of enclosed spaces and walls forming these enclosed spaces.

Figure 7:
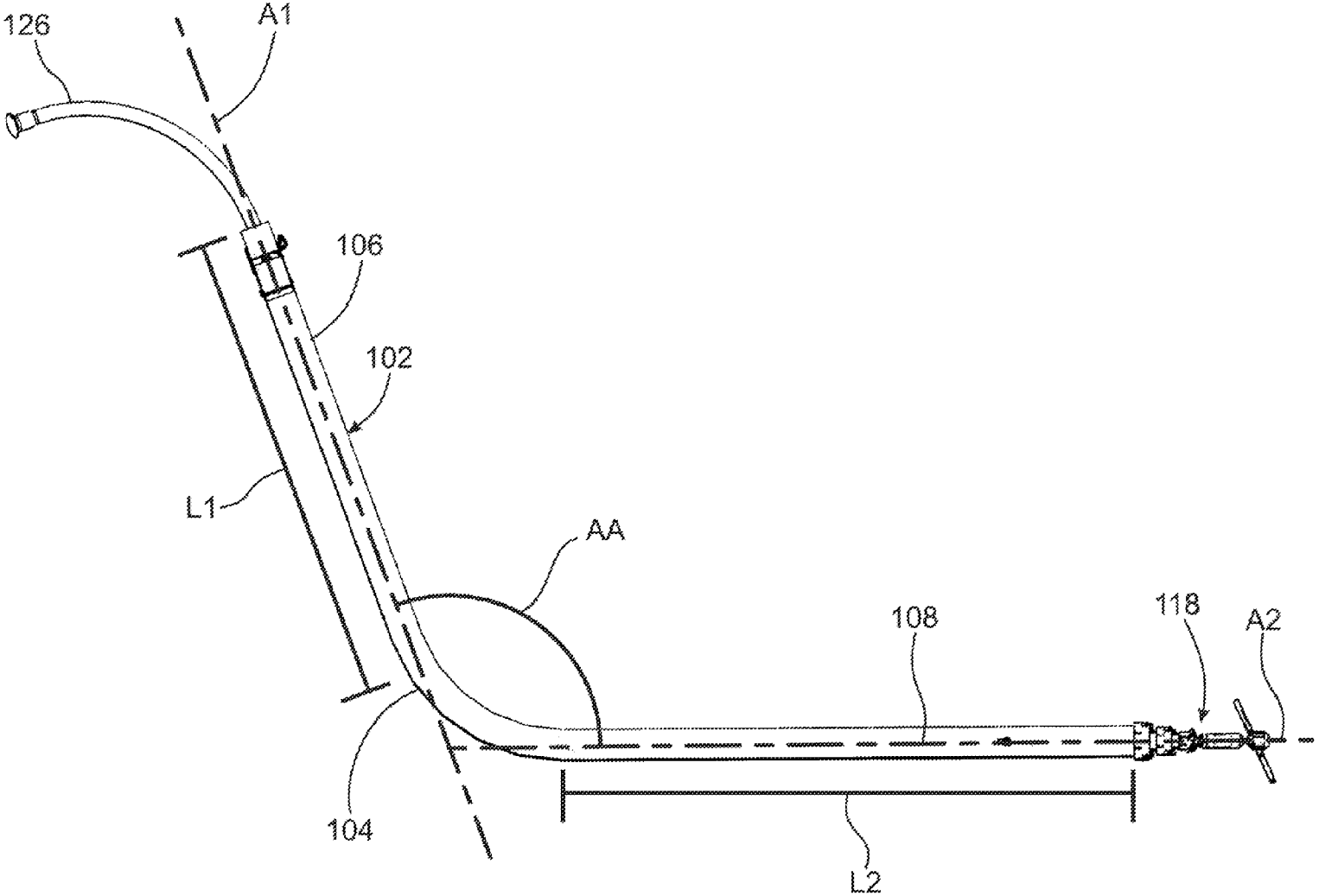
FIG. 7 is a perspective view of the tube shown in FIG. 1.

FIG. 7 is a perspective view of tube 102 shown in FIG. 1.

Figure 8:
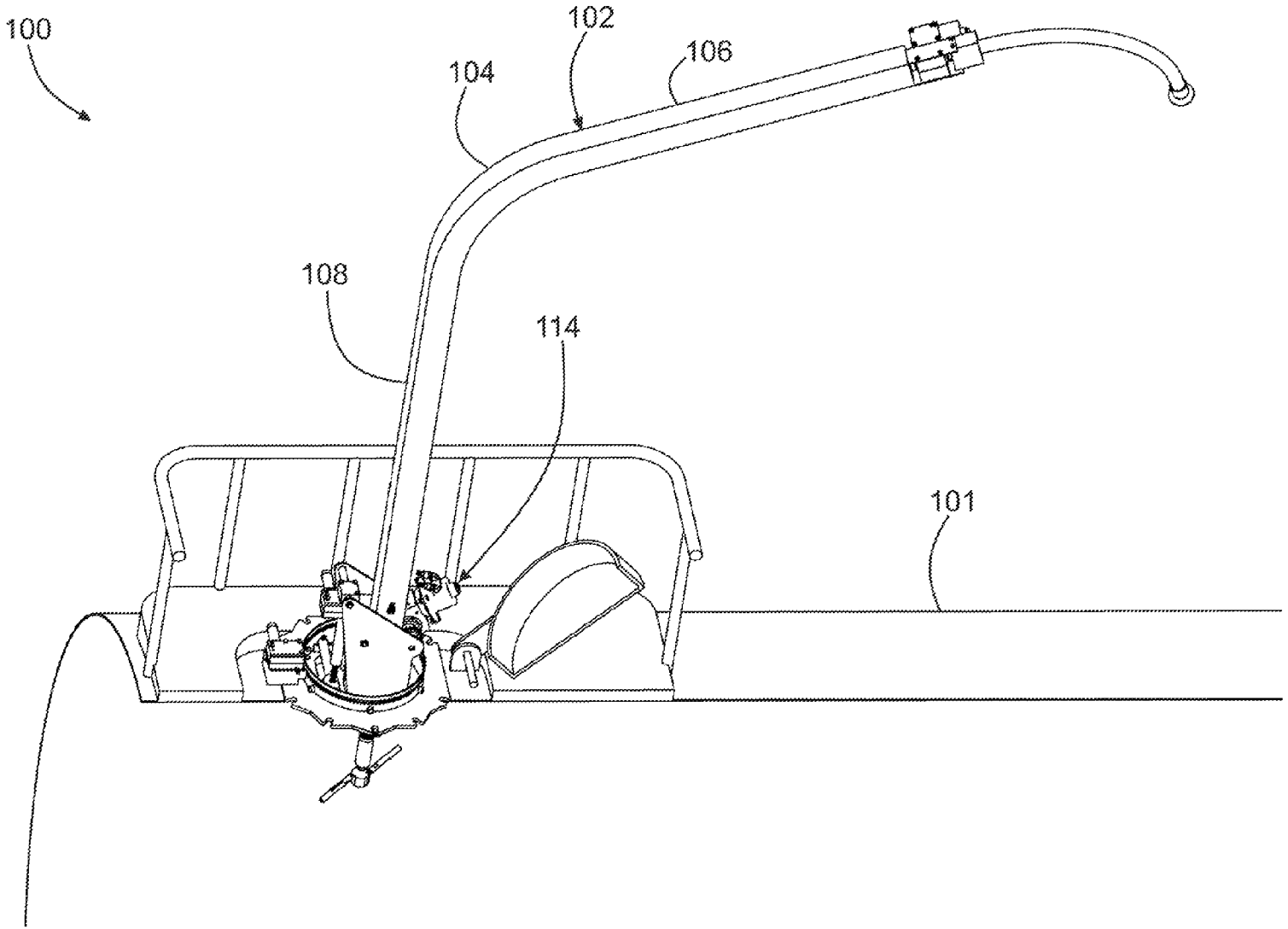
FIGS. 8 through 12 illustrate a sequence for positioning the apparatus shown in FIG. 1 in the tank; and, FIG. 13 is a schematic plan view illustrating alignment of the tube, shown in FIG. 1, in the tank opening to avoid an obstruction in the tank.

FIGS. 8 through 12 illustrate a sequence for positioning apparatus 100, shown in FIG. 1, in tank 101. The following should be viewed in light of FIGS. 1 through 12. In FIG. 8, end 112 of the tube is engaged with actuator 114 to start a process of inserting apparatus 100 into tank 101.

Figure 9:
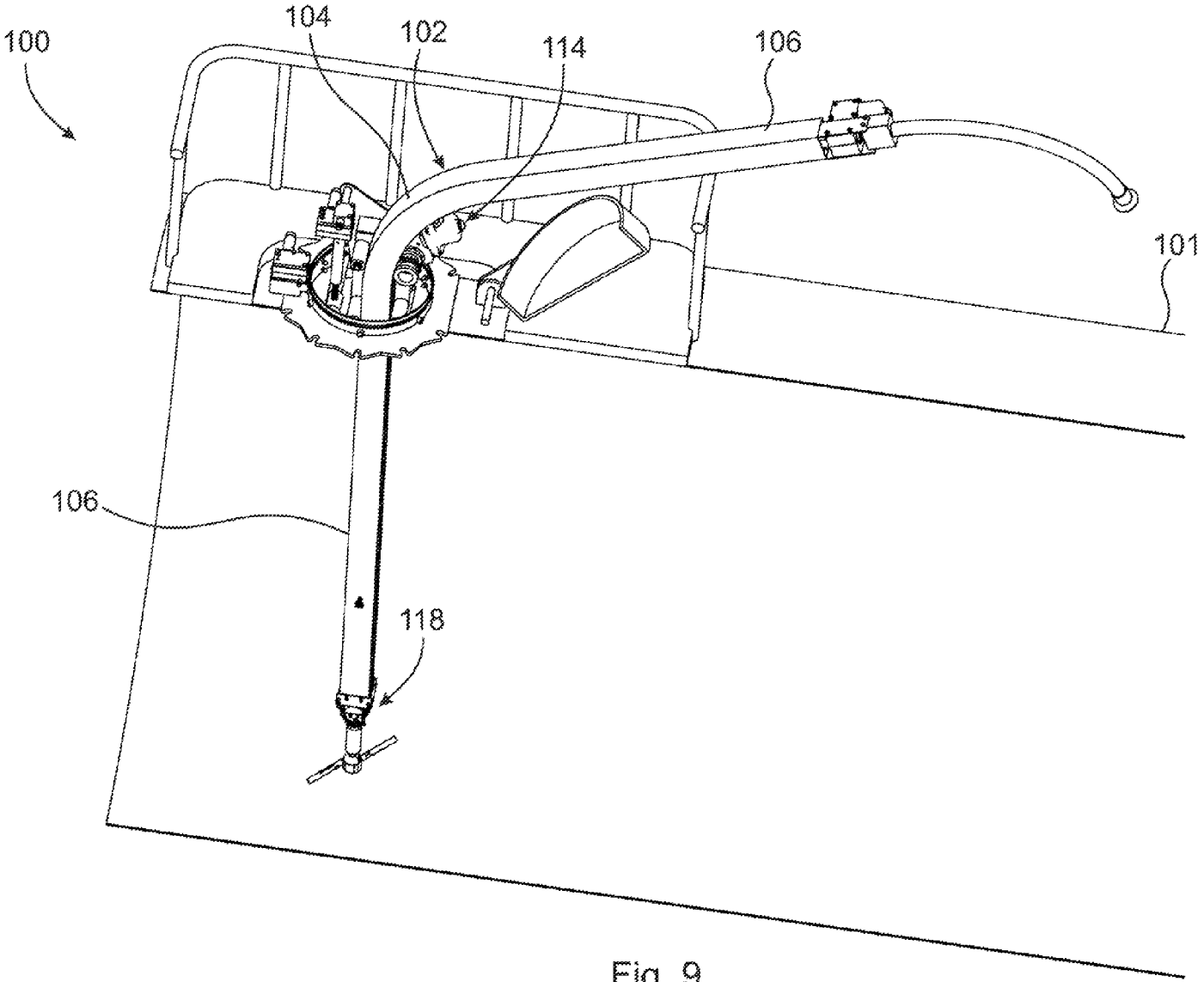

As shown in FIG. 9, further rotation of the gear in direction R1 displaces portion 108 of the tube down into the interior space of the tank.

Figure 10:
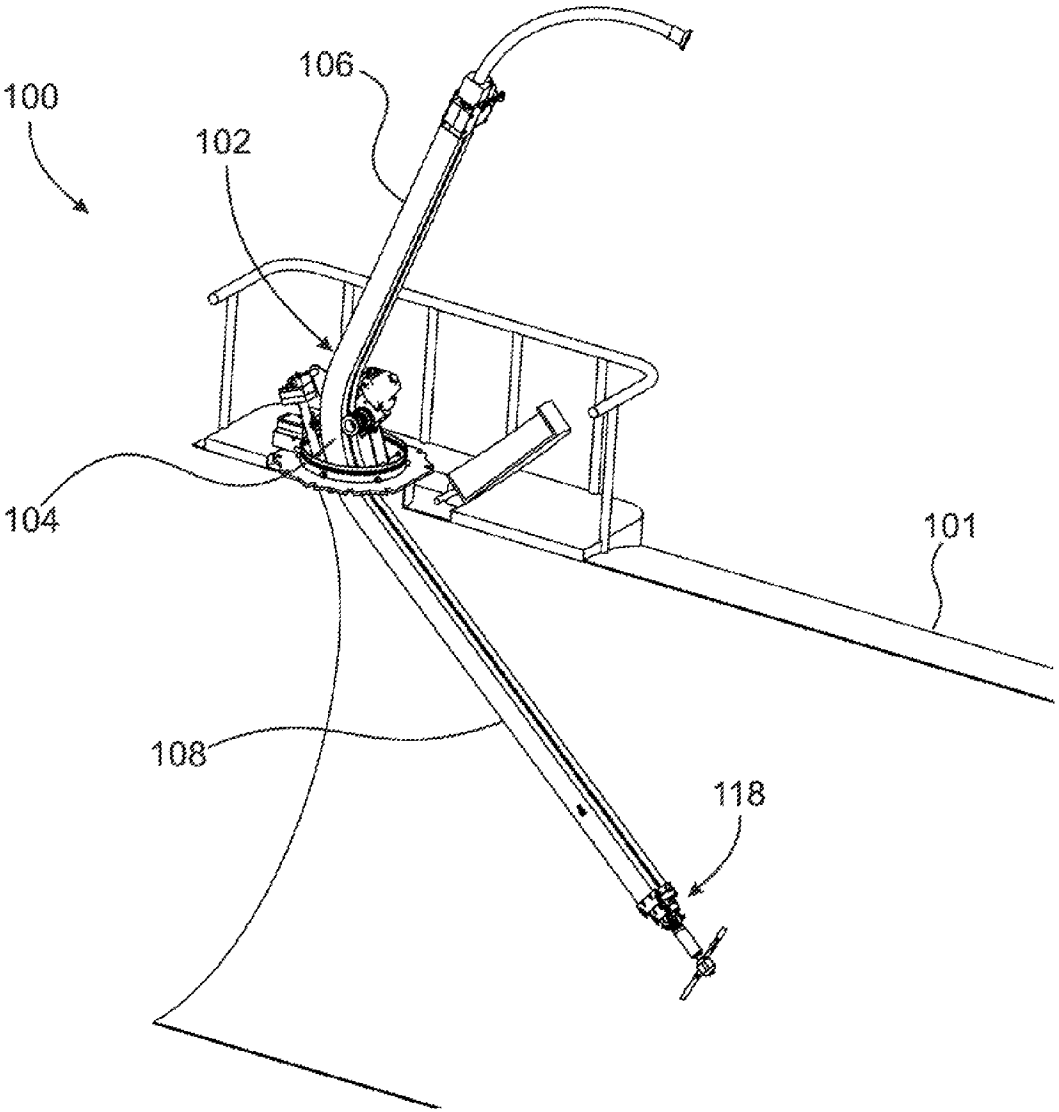

In FIG. 10, gear 142 has engaged features 138 in curved portion 104 of the tube. The tube is further displaced into the interior space; however, portion 108 is displacing both vertically and horizontally. That is, end 112 is beginning to swing toward end E of the tank.

Figure 11:
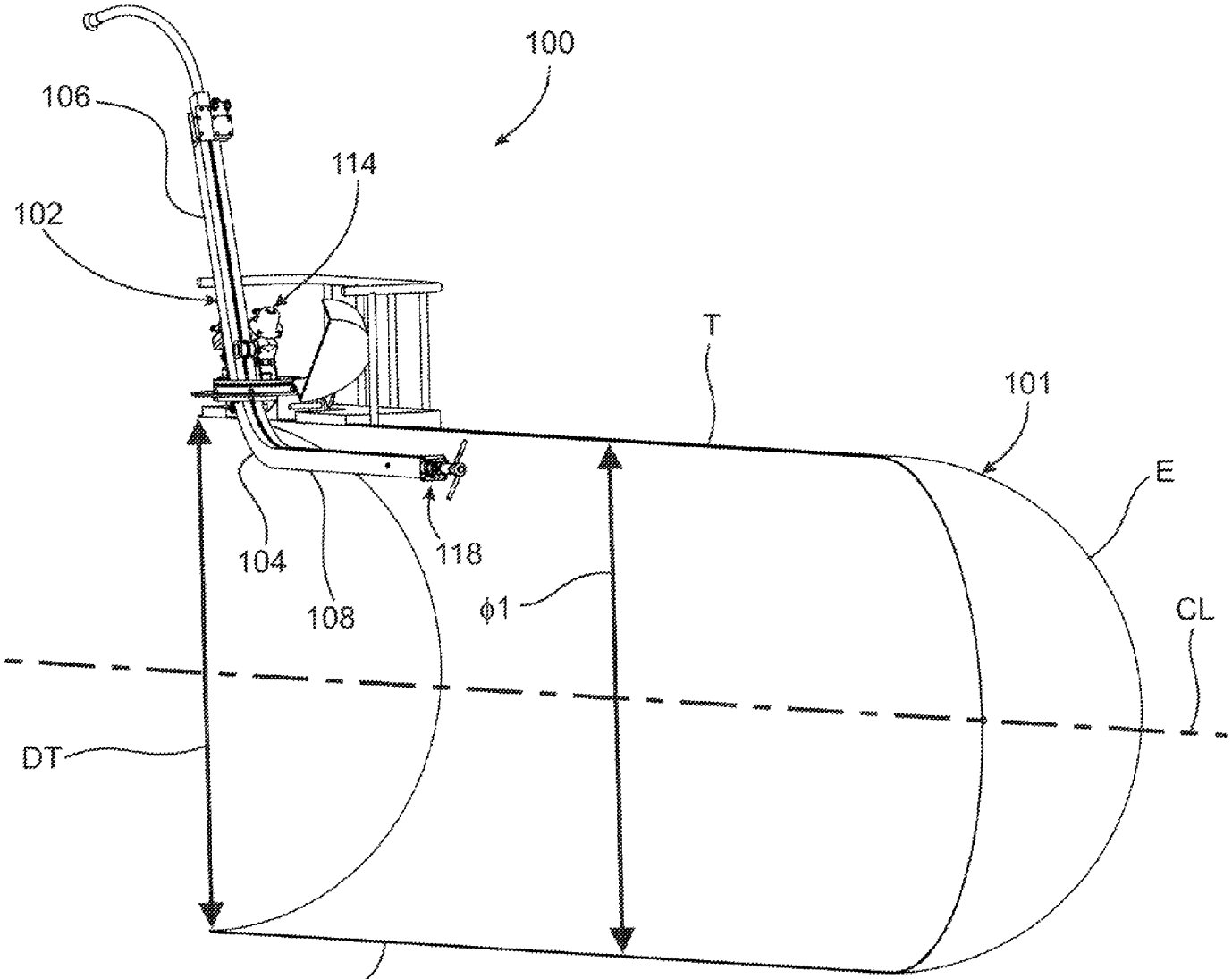

In FIG. 11, gear 142 is encountering features 138 in portion 106 of the tube. Portion 108 is now essentially horizontal, for example, essentially parallel to center line CL, but relatively close to top T of the tank.

Returning to FIG. 2, gear 142 has engaged features 138 in portion 106 of the tube to displace portion 106 down. In an example embodiment, axis A1 of portion 106 is at obtuse angle AA with respect to axis A2 of portion 108. Angle AA enables tube 102 to clear lids and railings that may be associated with an opening to an enclosed space, for example, on a rail tank car. Further, keeping angle AA as an obtuse angle, rather than a 90 degree angle, increases the rigidity and horizontal reach of tube 102. In an example embodiment (not shown), axis A1 of portion 106 is orthogonal to axis A2 of portion 108. Therefore, downward displacement of portion 106 simultaneously causes downward displacement of portion 108 while maintaining a desired orientation of portion 108, for example, a horizontal alignment of portion 108, which also could be a parallel alignment of portion 108 with the center line. Thus, displacement of portion 106 is used to position portion 108 (and nozzle assembly 130) between the top and bottom of the enclosed space.

Figure 12:
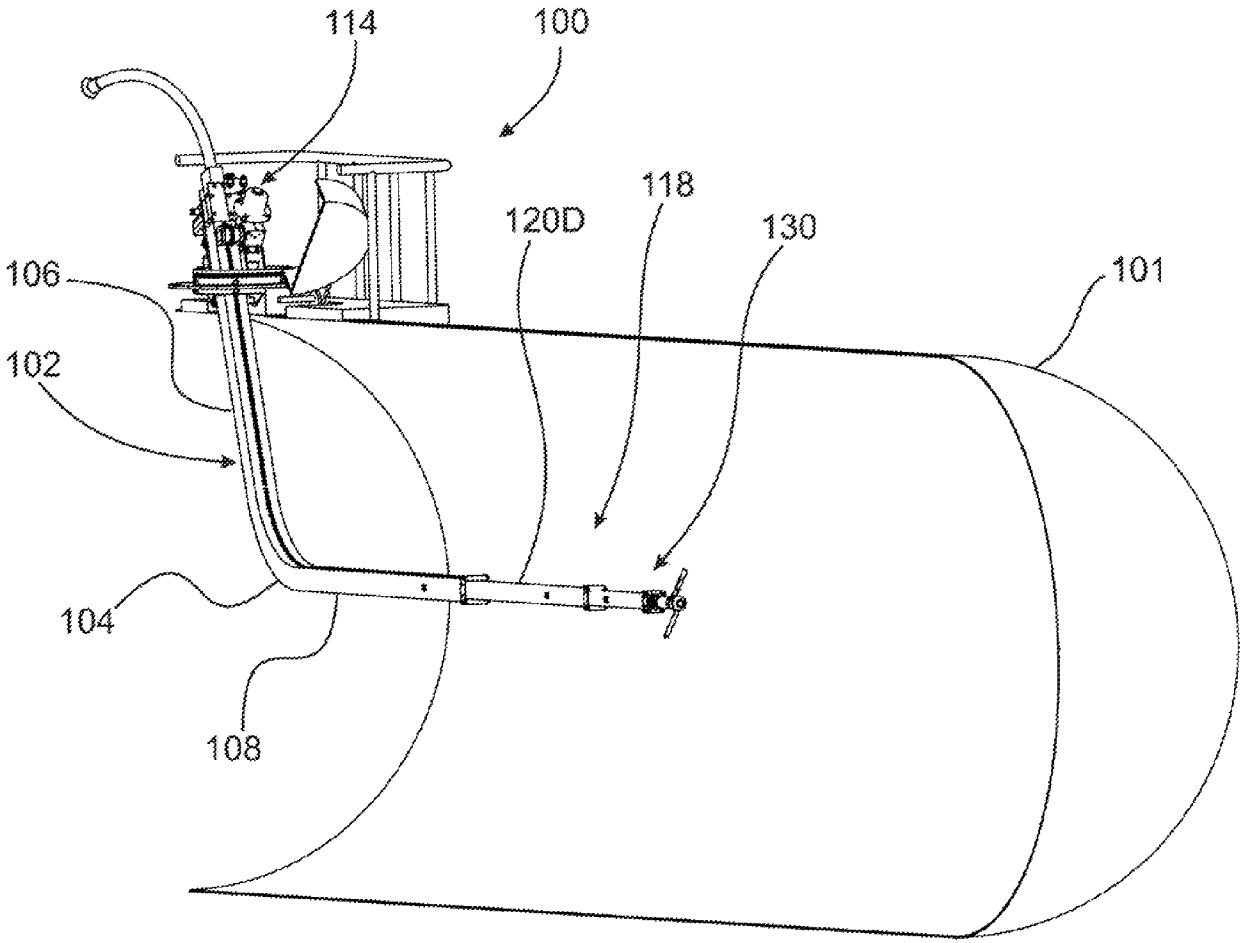

In FIG. 12, the position of the tube is stabilized and actuator 128 has displaced the hose in direction D1 such that segment 120D is fully extended from the tube.

Returning to FIG. 3, actuator 128 has continued to displace the hose in direction D1 such that segments 120A, 120B, 120C, and 120D are each fully extended.

It should be understood that actuator 114 can displace portion 106 both up and down to locate portion 108 in other positions, not shown, between the top and bottom of the tank. For example, length L1 of portion 106 can be great enough such that the actuator could displace portion 106 so that portion 108 is located between the center line and bottom B and still parallel to the center line.

Distance 154 between gear 142 and roller 150C, and distance 156 between rollers 150A and 150B, is such to enable curved portion 104 to translate past the gear and rollers. In an example embodiment, distances 154 and 156 are selected according to a desired sweep for portion 104.

In an example embodiment, apparatus 100 includes adjustment assembly 160 with base plate 162, frame 164 to which actuator 114 and the rollers are attached, and screw-type tilt actuator 166. Actuator 166 controls angle AF between frame 164 and the base plate. In an example embodiment, angle AF is adjustable to be between about 60 and 90 degrees. Angle AF can be selected to level the base plate for attachment to the tank while apparatus 100 being positioned, for example, suspended from an overhead hoist above the opening. Angle AF determines the angle at which portions 106 and 108 pass through opening 117 and into enclosed space 116, which in turn impacts the orientation of portion 108 within the enclosed space. As an example, to begin inserting the tube into the enclosed space as shown in FIGS. 4 and 8, actuator 166 is operated such that angle AF is about 90 degrees. This enables the tube to be advanced vertically downward to optimize coverage by assembly 130 of the midsection of the tank.

Once portions 104 or 106 are engaged by actuator 114, angle AF can be decreased, for example as shown in FIGS. 1 through 3 and 10 through 12 to control orientation of portion 108 and assembly 130 within the enclosed space. Angle AF can be used to reach "blind spots," for example, near end E of the tank that would be unreachable if angle AF were 90 degrees. Tilting frame 164 as shown in FIGS. 1 through 3 and 10 through 12 also can compensate for angle AA being an obtuse angle, for example, enabling portion 108 to be positioned horizontally as shown in FIGS. 2, 11, and 12. At the same time, the tilting of frame 164 enables the non-horizontal orientation of portion 108 shown in FIG. 6. Thus, virtually any angle or orientation needed to reach any portion of the enclosed space is enabled with assembly 160. Further, tilting frame 164 and tube 102 can advantageously enable the tube to clear the sides of the tank when rotating the tube, inside the tank, from one end of the tank to the other. Tilting frame 164 and tube 102 also can be used to clear obstacles outside the tank as the tube is inserted or withdrawn from the tank or rotated within the tank.

In an example embodiment, assembly 160 includes ring 168, rollers 170, and actuator 172 for rotating the frame with respect to the base plate. Actuator 172 can be any actuator known in the art. By rotating the frame while the tube is engaged with the frame, the tube can be rotated within the enclosed space, for example, such that assembly 130 displaces from facing end E of the tank to an opposite end of the tank. Rotation of assembly 160 would be implemented to sweep the internal surfaces of the tank shown in FIG. 6.

The extent of the vertical adjustment for the position of portion 108 inside the tank is related to length L1 of portion 106, the configuration of curved portion 104, and angles AF and AA. That is, actuator 114 operates on portion 106 between end point 174 of portion 106 (at the juncture with portion 104) and end 110 of the tube to adjust a horizontal position of portion 108. Tube 102 can be fabricated to have any length L1, configuration of portion 104, or angle AA. For example, length L1, configuration of portion 104, or angle AA can be determined according to the dimensions of the tank, for example, diameter Ø1 of the tank, and the tube can be fabricated accordingly.

In an example embodiment, tube 102 is a single monolithic piece. In an example embodiment (not shown), tube 102 is modular, for example, portions 104, 106, and 108 are separate pieces joined together to form tube 102. Thus, portions 106 and 108 having various lengths L1 and L2, respectively, and portions 104 having different configurations and angles AA can be combined to provide a wide range of configurations for tube 102.

A horizontal position attainable for end 112 and ultimately, for nozzle assembly 130, inside the tank is related to length L2 of portion 108, the configuration of curved portion 104, angles AF and AA, and extended length L3 of the telescoping mechanism. Advantageously, the shape of tube 102 and the use of actuator 114 and assembly 148 enable an optimization of length L2. As an example, a circular opening 117 for the tank has a certain diameter. Advantageously, length L2 can be considerably greater than the diameter for the opening and still pass through the opening since, as shown above, portion 108 is displaced vertically through the opening and then via the engagement of curved portion 104 with the actuator, portion 108 is positioned in a desired position within the tank. That is, portion 108 is inserted through the opening and then swung around into position, for example, to clean the tank. In general, the longest cross-sectional dimension of tube 102, for example, a diagonal, is much less than the diameter of the opening.

Without curved portion 104 and the sequence shown in FIGS. 8-11, 2, 12, 13, and 3, length L2 would be limited by the diameter of the opening, that is, L2 would need to be less than the diameter. For example, if portion 108 is held in a horizontal position outside of the tank, and if portion 108 is then lowered down into the tank, L2 would need to be less than the diameter of the opening to pass through opening 117. The above discussion is applicable to other configurations for opening 117. In general, for a non-circular opening 117, the smallest dimension for the opening is analogous to the diameter of the opening in the preceding discussion.

The maximum length L3 usable for a particular tank is related to distance DT between opening 117 and the bottom of the structure, across from the opening, forming the enclosed space. For example, as portion 108 is displaced down through opening 117, as shown in FIG. 9, the displacement must terminate when the nozzle is proximate the bottom of the tank. Advantageously, in the retracted mode, the telescoping mechanism extends only slightly past end 112 of the tube, which maximizes length L2 possible for a particular sized tank. As a further advantage, despite the nominal protrusion of the telescoping mechanism past end 112 in the retracted mode, the telescoping mechanism provides a significant and desirable extension of the distal segment (and nozzle assembly 130) in the extended mode. As yet another advantage, the cross-sectional area for the telescoping mechanism is no greater than or only slightly greater than the cross-sectional area for the tube. Thus, the telescoping mechanism does not present a significant increase in cross-section that would undesirably limit the size opening 117 through which the tube and mechanism can pass.

Since the length of the telescoping mechanism is affected by length L2 (the mechanism must fit within portion 108), optimizing length L2 as noted above, results in optimization of the space available for housing the telescoping mechanism in the retracted mode. That is, increasing length L2 can enable an increase in length L3. The number of nested segments in the telescoping mechanism, which is at least partly determined by the space available in passageway 124 in portion 108, also affects the maximum extent for L3. For example, the cross-section of passageway 124 can be increased or decreased to increase or decrease the number of nested segments that can fit inside portion 108, thus increasing or decreasing length L3.

The configuration of apparatus 100, specifically, the relatively gradual sweep of portion 104, advantageously enables the use of a stiffer, more durable hose, having a higher pressure rating and flow capacity. For example, as noted above, a hose used with swiveling, folding, or scissors arrangements must be very flexible to enable being folded, bent, or flexed, which limits the stiffness, durability, bore size, and pressure rating of the hose and which contribute to failure of the hose. In contrast, flexing of hose 126 is substantially limited to passing through the relatively large bend radius of portion 104, greatly reducing bending and flexing of the hose, for example, as compared to the folding or scissoring configurations noted supra.

Figure 13:
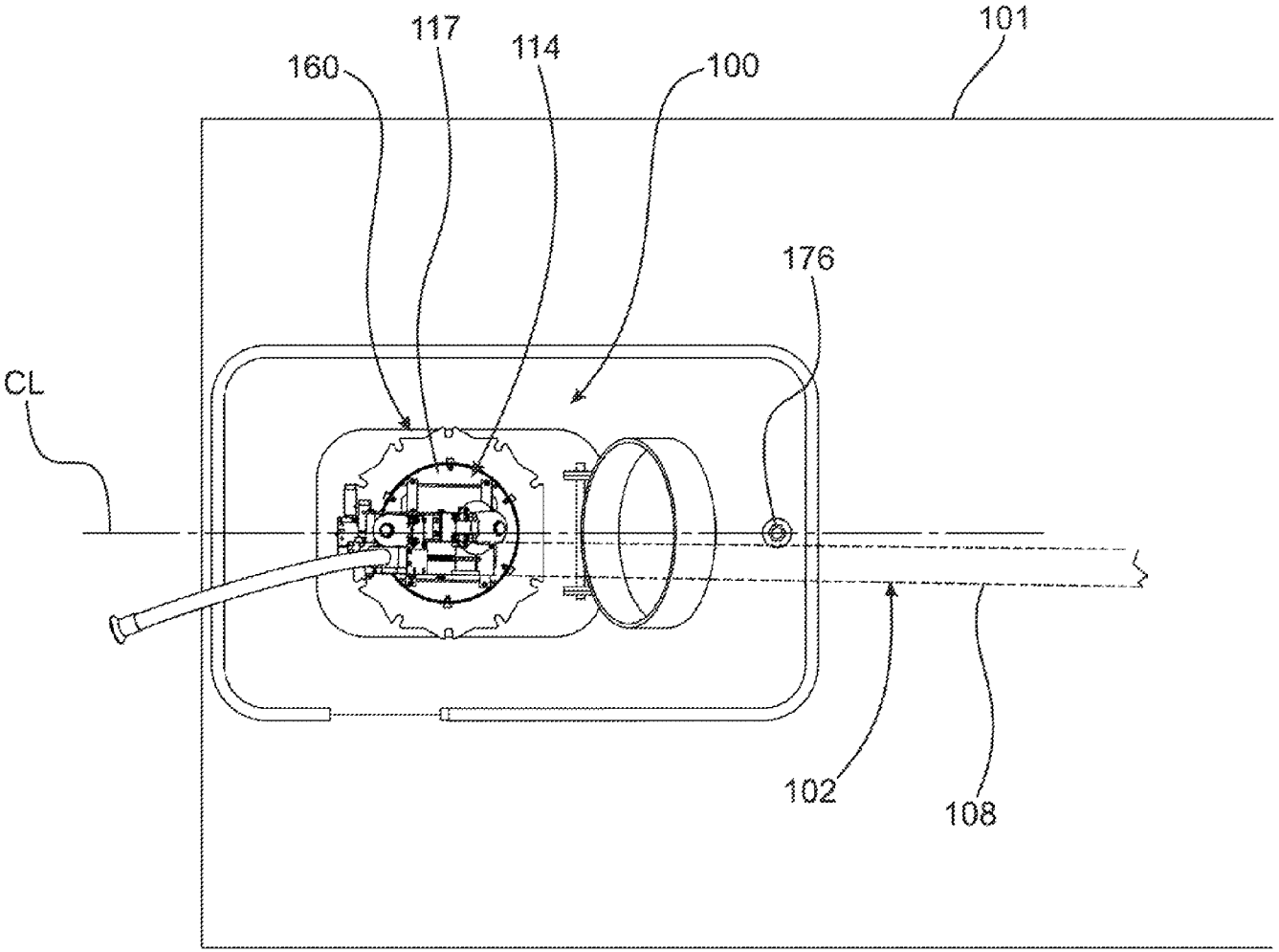

FIG. 13 is a schematic plan view illustrating alignment of tube 102, shown in FIG. 1, in opening 117 to avoid an obstruction in the tank. In some cases, an obstruction, such as valve rod 176 in space 116 is positioned, for example, extends far enough toward bottom B, so as to interfere with placement of the tube within the enclosed space if the tube is centered with respect to opening 117. For example, opening 117 is centered on line CL and valve rod is aligned with center line CL. Advantageously, the relatively small cross-sectional area of the tube and telescoping mechanism enables the tube to pass through opening 117, while being out of alignment with CL. Thus, assembly 160 can be placed such that portion 108 avoids the obstruction. For example, portion 108 is parallel to CL in the interior space of the tank and slightly out of alignment with CL in order to avoid the obstruction and maximize portions of the enclosed space accessible by tube 102.

Specifically, the cross-sectional area of the tube and telescoping mechanism is typically less, and often significantly less than the area of opening 117. Therefore, there is a considerable degree of freedom with respect to where assembly 160 is placed with respect to the opening, and subsequently, the position of the tube as the tube passes through the opening into space 116. As shown in FIG. 13, the tube can be positioned in the opening to be offset from the obstruction, for example, offset from CL. The relatively small cross-sectional area of the tube and telescoping mechanism also enables simultaneous use of two apparatuses 100 in the same tank. Base plate 162 can be sized or configured to accommodate various sizes and shapes of openings and structures around openings to optimize the ability to vary the point at which the tube is inserted through the opening, or to optimize the ability to install two apparatuses 100 over an opening.

Thus, it is seen that the objects of the invention are efficiently obtained, although changes and modifications to the invention should be readily apparent to those having ordinary skill in the art, without departing from the spirit or scope of the invention as claimed. Although the invention is described by reference to a specific preferred embodiment, it is clear that variations can be made without departing from the scope or spirit of the invention as claimed.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An apparatus for insertion in an enclosed space, comprising:

a rigid tube with:

first and second substantially straight portions including first and second ends of the tube, respectively; and, a curved portion connecting the first and second portions;

a plurality of nested segments at least partially disposed within the first substantially straight portion of the tube and connected to the first substantially straight portion; and, a first actuator engageable with the first and second substantially straight portions and the curved portion of the tube to displace the first and second substantially straight portions of the tube into and out of the enclosed space through an opening into the enclosed space, wherein:

the tube is arranged to accept a hose passing through the tube; and, a distal segment from the plurality of nested segments is connectable to the hose.

2. The apparatus of claim 1, wherein:

displacement of the hose in a first direction causes respective portions of the nested segments to displace away from the first end of the tube; and, displacement of the hose in a second direction, opposite the first direction, causes the respective portions of the nested segments to displace toward the first end of the tube.

3. The apparatus of claim 2, further comprising a second actuator fixed proximate the second end of the tube, wherein:

the second actuator is engageable with the hose; and, the second actuator displaces the hose in the first and second directions.

4. The apparatus of claim 2, wherein the distal segment is arranged to connect to a nozzle.

5. The apparatus of claim 1, wherein:

the enclosed space is formed by a tank; and, the tube is displaceable into the tank such that the first substantially straight portion is parallel to a center line for the tank.

6. The apparatus of claim 1, wherein:

the enclosed space is formed by-a tank; and, the second substantially straight portion is displaceable by the first actuator to vary a position of the first substantially straight portion, in the tank, with respect to a center line for the tank while keeping the first substantially straight portion parallel to the center line.

7. The apparatus of claim 1, wherein the tube is displaceable into the enclosed space such that the first substantially straight portion is horizontal.

8. The apparatus of claim 1, wherein the second substantially straight portion is displaceable by the actuator to vary a vertical position of the first substantially straight portion within the enclosed space while keeping the first substantially straight portion horizontal.

9. The apparatus of claim 1, wherein:

the tube is displaceable into the enclosed space such that the first substantially straight portion is at an acute angle with respect to a horizontal line; and, the second substantially straight portion is displaceable by the actuator to vary a vertical position of the first substantially straight portion within the enclosed space while keeping the first substantially straight portion at the acute angle with respect to the horizontal line.

10. The apparatus of claim 1, wherein:

the tube includes an exterior surface with a plurality of first gripping features along at least a portion of the exterior surface;

the first actuator is fixable in a location with respect to the enclosed space and includes a plurality of second gripping features;

the first and second pluralities of gripping features are engageable with each other; and, displacement of the second plurality of gripping features causes the displacement of the tube into and out of the enclosed space.

11. The apparatus of claim 10, wherein:

the first actuator includes a gear with a plurality of teeth forming the second plurality of gripping features;

rotation of the gear in a first direction causes the displacement of the tube into the enclosed space; and, rotation of the gear in a second direction, opposite the first direction, causes displacement of the tube out of the enclosed space.

12. The apparatus of claim 1, wherein the first substantially straight portion has a length greater than a width of the opening.

13. An apparatus for insertion in a vessel, comprising:

a rigid tube including:

first and second substantially straight portions including first and second ends of the tube, respectively;

a curved portion connecting the first and second portions; and, an exterior surface with a plurality of indentations or openings;

a plurality of telescoping segments at least partially disposed within the first portion at the first end of the tube; and, an actuator including a rotatable gear with a plurality of teeth engageable with the plurality of indentations or openings so that rotation of the gear displaces the first portion, the curved portion, and part of the second portion of the tube into and out of the vessel, wherein:

the first substantially straight portion has a length greater than a width of an opening for the vessel;

the tube is arranged to accept a hose passing through the tube;

the hose is connectable to a distal segment from the plurality of telescoping segments;

displacement of the hose in a first direction causes respective portions of the telescoping segments to displace away from the first end of the tube; and, displacement of the hose in a second direction, opposite the first direction, causes the respective portions of the telescoping segments to displace toward the first end of the tube.

14. An apparatus for insertion in an enclosed space, comprising:

a rigid tube having sequentially a first end, a first substantially straight portion, a curved portion, and a second substantially straight portion having a second end;

a plurality of nested segments at least partially telescopically disposed within and connected to the first straight portion of the tube; and, a first actuator adapted to be fastened in a fixed position relative to an opening into an enclosed space, wherein the first actuator is engageable with the tube and is operable to displace the first substantially straight portion, the curved portion, and the second substantially straight portions of the tube sequentially into and out of the enclosed space through the opening into the enclosed space, wherein:

the tube is arranged to accept a hose passing through the tube; and, a distal segment from the plurality of nested segments is connectable to the hose.

15. The apparatus of claim 14, wherein:

displacement of the hose in a first direction causes respective portions of the nested segments to displace away from the first end of the tube; and, displacement of the hose in a second direction, opposite the first direction, causes the respective portions of the nested segments to displace toward the first end of the tube.

16. The apparatus of claim 15, further comprising a second actuator fixed proximate the second end of the tube, wherein:

the second actuator is engageable with the hose; and, the second actuator displaces the hose in the first and second directions.

17. The apparatus of claim 15, wherein the distal segment is arranged to connect to a nozzle.

18. The apparatus of claim 14, wherein:

the enclosed space is a tank; and, the tube is displaceable into the tank such that the first substantially straight portion is parallel to a center line for the tank.

19. The apparatus of claim 14, wherein:

the enclosed space is a tank; and, the second substantially straight portion is displaceable by the first actuator to vary a position of the first substantially straight portion, in the tank, with respect to a center line for the tank while keeping the first substantially straight portion parallel to the center line.

20. The apparatus of claim 14, wherein the tube is displaceable into the enclosed space such that the first substantially straight portion is horizontal.

21. The apparatus of claim 14, wherein the second substantially straight portion is displaceable by the actuator to vary a vertical position of the first substantially straight portion within the enclosed space while keeping the first substantially straight portion horizontal.

22. The apparatus of claim 14, wherein:

the tube is displaceable into the enclosed space such that the first substantially straight portion is at an acute angle with respect to a horizontal line; and, the second substantially straight portion is displaceable by the actuator to vary a vertical position of the first substantially straight portion within the enclosed space while keeping the first substantially straight portion at the acute angle with respect to the horizontal line.

23. The apparatus of claim 14, wherein:

the tube includes an exterior surface with a plurality of first gripping features along at least a portion of the exterior surface;

the first actuator is fixable in a location with respect to the enclosed space and includes a plurality of second gripping features;

the first and second pluralities of gripping features are engageable with each other; and, displacement of the second plurality of gripping features causes the displacement of the tube into and out of the enclosed space.

24. The apparatus of claim 23, wherein:

the first actuator includes a gear with a plurality of teeth forming the second plurality of gripping features;

rotation of the gear in a first direction causes the displacement of the tube into the enclosed space; and, rotation of the gear in a second direction, opposite the first direction, causes displacement of the tube out of the enclosed space.

25. The apparatus of claim 14, wherein the first substantially straight portion has a length greater than a width of the opening.

* * * * *